US005746269A

United States Patent [19]

Torii et al.

[11] Patent Number: 5,746,269

[45] Date of Patent: May 5, 1998

[54] REGENERATIVE HEAT EXCHANGER

[75] Inventors: Akito Torii; Kimio Kohara, both of Nisshin, Japan

[73] Assignee: Advanced Mobile Telecommunication Technology Inc., Nisshin, Japan

[21] Appl. No.: 682,077

[22] Filed: Jul. 17, 1996

[30] Foreign Application Priority Data

Feb. 8, 1996 [JP] Japan ..... 8-022209

[51] Int. Cl.[6] ..... F28D 17/00

[52] U.S. Cl. ..... 165/10; 165/6; 165/4; 62/259.1; 62/259.3; 62/6; 62/430

[58] Field of Search ..... 165/10, 4, 185, 165/8, 6; 29/890.06; 62/6, 259.3, 259.1, 430

[56] References Cited

U.S. PATENT DOCUMENTS

| | | | |
|---|---|---|---|
| 2,900,798 | 8/1959 | Jonkers | 62/6 X |
| 3,216,484 | 11/1965 | Gifford | 165/4 |
| 3,692,095 | 9/1972 | Fleming | 165/4 |
| 3,692,099 | 9/1972 | Nesbitt et al. | 62/6 X |
| 3,960,204 | 6/1976 | Horn | 165/10 X |
| 4,201,206 | 5/1980 | Kuehn et al. | 165/10 X |
| 4,259,844 | 4/1981 | Sarcia et al. | 165/10 X |
| 4,429,732 | 2/1984 | Moscrip | 165/10 |
| 4,478,046 | 10/1984 | Saito et al. | 62/6 |
| 4,612,912 | 9/1986 | Lampe | 165/10 X |
| 4,830,092 | 5/1989 | Lee | 165/10 X |
| 5,165,466 | 11/1992 | Arbabian | 165/10 X |
| 5,522,223 | 6/1996 | Yanai et al. | 62/6 |

FOREIGN PATENT DOCUMENTS

| | | | |
|---|---|---|---|
| 0064049 | 5/1977 | Japan | 165/10 |
| 0002896 | 1/1985 | Japan | 165/10 |
| 0059192 | 3/1986 | Japan | 165/10 |
| 0233688 | 10/1987 | Japan | 165/10 |
| 0175507 | 7/1961 | Sweden | 165/4 |
| 1022404 | 3/1966 | United Kingdom | 165/4 |

*Primary Examiner*—John Rivell
*Assistant Examiner*—Christopher Atkinson
*Attorney, Agent, or Firm*—Lane, Aitken & McCann

[57] ABSTRACT

Herein disclosed is a regenerative heat exchanger comprising a cylindrical core casing and a stack body core formed by a plurality of circular mesh plates each having fluid passage holes and stacked on one another to form fluid passageways. The stack body core is housed in the core casing to have a fluid cooling medium introduced into the fluid passageways to carry out heat exchange between the stack body core and the fluid cooling medium. Each of the mesh plates has on its outer periphery a reference mark portion positioned with respect to the fluid passage holes, and the mesh plates collectively form a row of reference mark portions indicative of the form of each of the fluid passageways. The row of reference mark portions enables to easily modify or adjust the shapes of the fluid passageways of the stack body core by relatively rotating the mesh plates with reference to the reference mark portions.

7 Claims, 13 Drawing Sheets

REGENERATIVE HEAT EXCHANGER

BACKGROUND OF THE INVENTION

The present invention relates to a regenerative heat exchanger to be operated under a high pressure fluid cooling medium, and more particularly to a regenerative heat exchanger which is assembled with a reversed Stirling refrigerator, a GM(Gifford-McMahon) refrigerator, a pulse tube refrigerator and other very low temperature refrigerators.

Conventionally, there have been provided a wide variety of regenerative heat exchangers utilized for very low temperature refrigerators one of which is shown in FIG. 11 as comprising a compression cylinder 1, an expansion cylinder 2 having an open end portion 2*a*, a fluid conduit 3 provided between the compression and expansion cylinders 1 and 2 to have the cylinders 1 and 2 held in fluid communication with each other, a compression piston 4 housed in the compression cylinder 1 to be reciprocally slidable in the compression cylinder 1, an expansion piston 7 housed in the expansion cylinder 2 to be reciprocally slidable in the expansion cylinder 2, a core unit 8 having a plurality of mesh plates 8*a* and a core casing 8*b* housed in the expansion piston 7 to stack the mesh plates 8*a* in the expansion cylinder 2, a plurality of seal ring members 4*a*, 7*a*, 7*b* and 7*c*, and a cooling cover 9 connected to the expansion cylinder 2 to close the open end portion 2*a* of the expansion cylinder 2. The above mesh plates number more than 1000 and each called "matrix".

The compression piston 4 is adapted to define a compression chamber 5 and to be reciprocated by a driving means. The core unit 8 is housed in the expansion cylinder 2 to define an expansion chamber 6 and to be reciprocated by another driving means. The compression chamber 5 and the expansion chamber 6 each accommodate a fluid cooling medium consisting of a highly pressurized refrigerant gas such as helium, hydrogen and nitrogen. The reciprocal motions of the compression and expansion pistons 4 and 7 cause the compression chamber 5 and the expansion chamber 6 to respectively be varied in volume, thereby making it possible to move the fluid cooling medium between both chambers 5 and 6. Each of the mesh plates 8*a* of the core unit 8 is formed to be circular and to have a plurality of slit-like fluid passage holes. The fluid passage holes respectively form a plurality of fluid passageways when the mesh plates 8*a* are stacked on one another to form the core unit 8 in the expansion cylinder 2.

The above refrigerator is operated to perform the reversed Stirling cycle by compressing and expanding the fluid cooling medium while the compression and expansion pistons 4 and 7 are respectively reciprocated in the compression and expansion chambers 5 and 6.

FIG. 12 shows a solid sine curve "A" and a dot-chain sine curve "B", the former of which indicates the locus of the expansion piston 7 during one reciprocating motion which provides an isothermal compression stroke (1), an isovolumetric heat discharging stroke (2), an isothermal expansion stroke (3), and an isovolumetric heat charging stroke (4), and the latter of which indicates the locus of the compression piston 4 during one reciprocating motion. Each of the marks "●" indicates the top dead center of the piston 4 or 7, while each of the marks "○" indicates the bottom dead center of the piston 4 or 7. The marks "▲" shown in FIG. 12 respectively indicate intermediate points between the top and bottom dead centers. As shown in this figure, the reciprocating cycle of the compression piston 4 is the same as that of the expansion piston 7, but the cycle of the compression piston 4 is delayed from that of the expansion piston 7 by one fourth of the reciprocating cycle of the each piston 4 or 7, i.e., a phase angle of 90 degrees.

The isothermal compression stroke (1) is performed to have the fluid cooling medium in the compression chamber 5 compressed to produce heat in the fluid cooling medium, and to have the fluid cooling medium forced out of the compression chamber 5 through the fluid conduit 3. The fluid cooling medium from the compression chamber 5 is moved to the expansion cylinder 2.

The fluid cooling medium is introduced into the expansion chamber 6 through the core unit 8 during the isovolumetric heat discharging stroke (2), and cooled by the core unit 8 by performing heat exchange between the mesh plates 8*a* and the fluid cooling medium passing therethrough.

The isothermal expansion stroke (3) is then performed to have the fluid cooling medium in the expansion chamber 6 isothermally expanded as the expansion chamber 6 expands. At this time, the fluid cooling medium absorbs heat and deprives the cooling cover 9 of heat so as to cool an object 10 positioned on the cooling cover 9. The object 10 on the cooling cover 9 is therefore cooled by the cooling cover 9.

In the isovolumetric heat charging stroke (4), the fluid cooling medium is discharged from the expansion chamber 6 through the core unit 8 without varying its volume. The fluid cooling medium is heated at this time by performing the heat-exchange between the mesh plates 8*a* and the fluid cooling medium passing therethrough to a degree that the temperature of the fluid cooling medium reaches to the initial temperature.

The core unit 8 has a high heat-exchange rate enough to cool and refrigerate the object 10 on the cooling cover 9 to the very low temperature. In addition, the mesh plates 8*a* are each shaped to be circular by means of a blanking die from a mesh screen which is preliminarily formed with a number of minute holes. The blanked mesh plates 8*a* are then stacked on one another to form the core unit 8 with a plurality of fluid passageways. This makes it possible to produce the core unit 8 at a low cost.

The above prior-art regenerative heat exchanger, however, is liable to encounter a drawback that the fluid passage holes of each of the mesh plates 8*a* are slightly different in position from those of another mesh plate 8*a* stacked up in the core casing 8*b*, and that the actual shapes of the fluid passageways are different from their theoretical shapes. The actual shapes of the fluid passageways are also varied when the mesh plates 8*a* are stacked up again in different order. This leads to a difficulty in forming the fluid passageways to have their accurate shapes.

In addition, the fluid passageways of the core unit 8 cannot be modified or adjusted in their shapes such as diameters, sectional areas, lengths and directions of the fluid passageways into other desirable shapes without changing the shapes of the mesh plates 8*a* or the size of the core casing 8*b*. This leads to the fact that a number of new mesh plates are required to modify the shapes of the fluid passageways and thus raise the production cost of the regenerative heat exchanger.

The present invention contemplates provision of an improved regenerative heat exchanger overcoming the drawbacks of the prior-art regenerative heat exchanger of the described general natures.

SUMMARY OF THE INVENTION

It is therefore an object of the present invention to provide a regenerative heat exchanger having a plurality of mesh plates which can be adjusted and changed in the shapes of their fluid passageways in spite of the fact that the mesh plates have their respective circular shapes.

According to one aspect of the present invention there is provided a regenerative heat exchanger comprising a core casing having first and second openings, and a stack body core formed by a plurality of mesh plates each having a plurality of fluid passage holes and stacked on one another to form a plurality of fluid passageways consisting of the plurality of fluid passage holes. The stack body core is housed in the core casing to have the fluid passageways held in fluid communication with the first and second openings, and is adapted to have a fluid cooling medium introduced into the fluid passageways to carry out heat exchange between the stack body core and the fluid cooling medium. In the regenerative heat exchanger, each of the mesh plates has on its periphery a reference mark portion positioned with respect to the fluid passage holes around the center axis of the stack body core, and the mesh plates collectively form a row of reference mark portions to indicate the form of each of the fluid passageways.

Each of the above fluid passage holes may be formed in the shape of a slit elongated in a predetermined elongation direction with respect to the reference mark portion. In this case, the stacked mesh plates have the fluid passage holes identical with or different from one another in the elongation direction.

Each of the mesh plates may have a flat photo resist layer surrounding the openings of the fluid passage holes.

The reference mark portion may be triangular in shape and may protrude from the remaining outer or inner peripheral portion of the mesh plate.

BRIEF DESCRIPTION OF THE DRAWINGS

The features and advantages of a regenerative heat exchanger according to the present invention will be more clearly understood from the following description taken in conjunction with the accompanying drawings in which.

DESCRIPTION OF THE PREFERRED EMBODIMENTS

Figure 1:
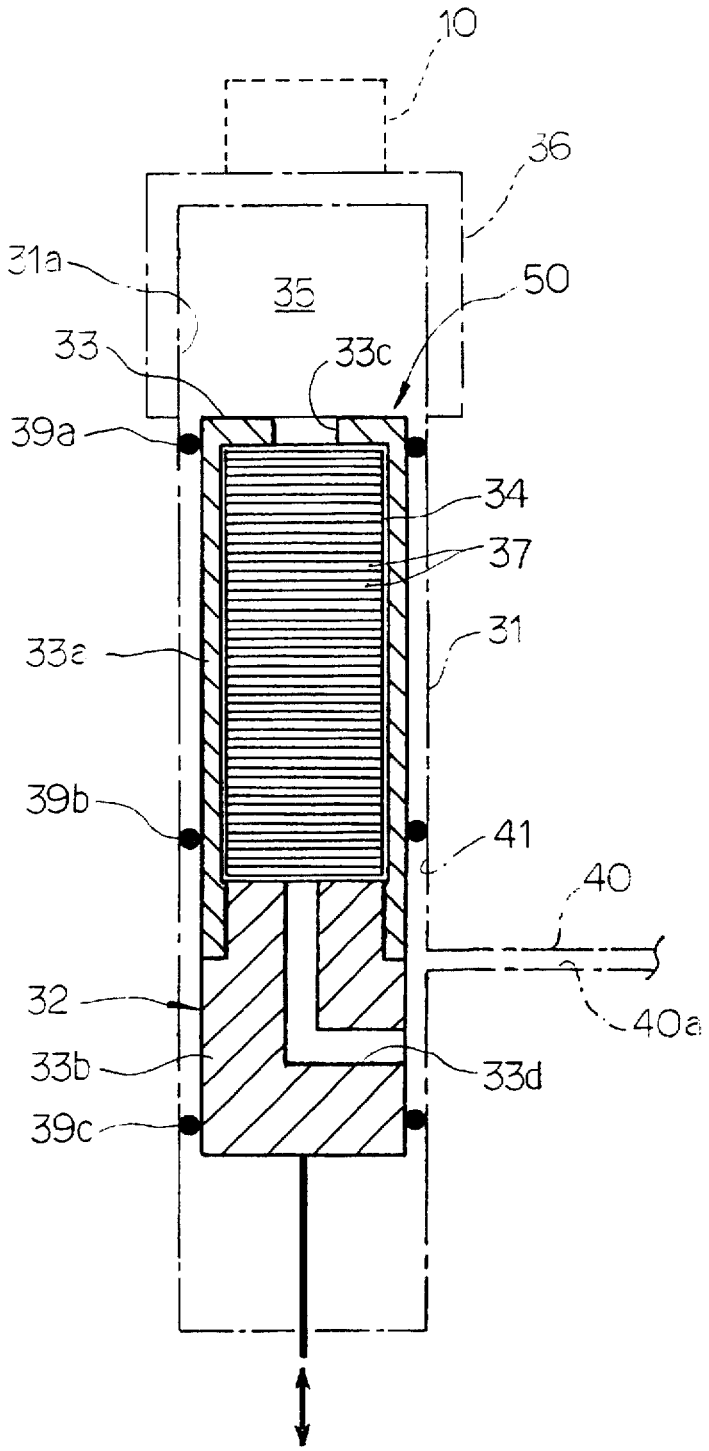
FIG. 1 is a longitudinal sectional view of a preferred embodiment of the regenerative heat exchanger according to the present invention.
Figure 2:
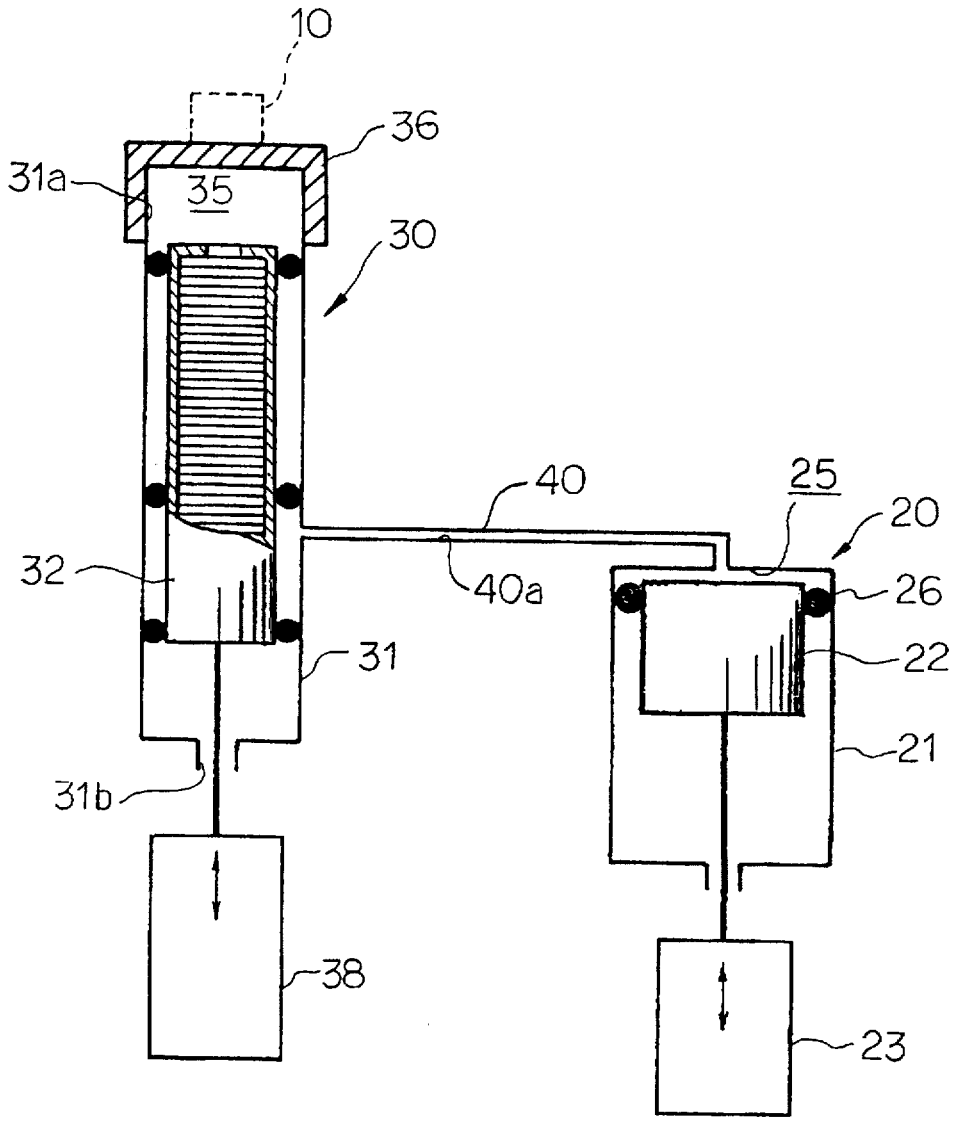
FIG. 2 is a schematic view of a refrigerator system including the regenerative heat exchanger.

Referring to FIGS. 1 and 2 of the drawings, a preferred embodiment of a regenerative heat exchanger embodying the present invention is shown as being used for a reversed Stirling refrigerator. The refrigerator roughly comprises a compression cylinder unit 20, an expansion cylinder unit 30, and a fluid conduit 40 provided between the cylinder units 20 and 30.

The compression cylinder unit 20 comprises a compression cylinder 21 and a compression piston 22 received in the compression cylinder 21 to define in the compression cylinder 21 a cylindrical compression chamber 25 which can be changed in volume when the compression piston 22 is moved between its uppermost and lowermost positions, i.e., the top and bottom dead centers by driving means 23. Between the compression cylinder 21 and the compression piston 22 is positioned a seal ring 26 which serves to hermetically seal the gap formed by the inner surface of the compression cylinder 21 and the outer surface of the compression piston 22.

The expansion cylinder unit 30 comprises an expansion cylinder 31 having upper and lower open ends 31*a* and 31*b*, an expansion piston 32 received in the expansion cylinder 31 and reciprocally movable in a predetermined cycle, and a cooling cover 36 covering and closing the upper open end portion of the expansion cylinder 31 and encircling the expansion chamber 35. On the cooling cover 36 is mounted a cooling object 10 which is cooled by the fluid cooling medium as will be understood as the description proceeds.

Figure 3A:
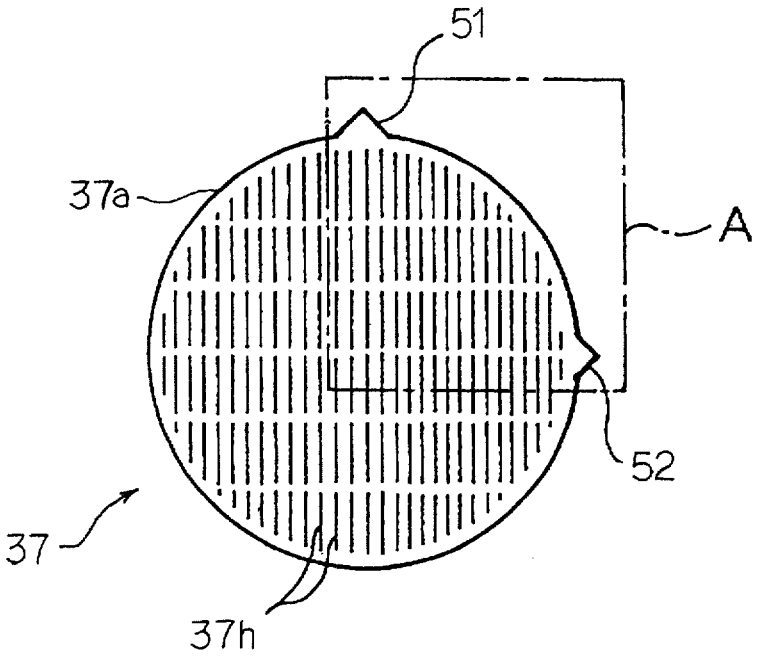
FIG. 3*a* is a plan view of a mesh plate forming part of the regenerative heat exchanger.
Figure 3B:
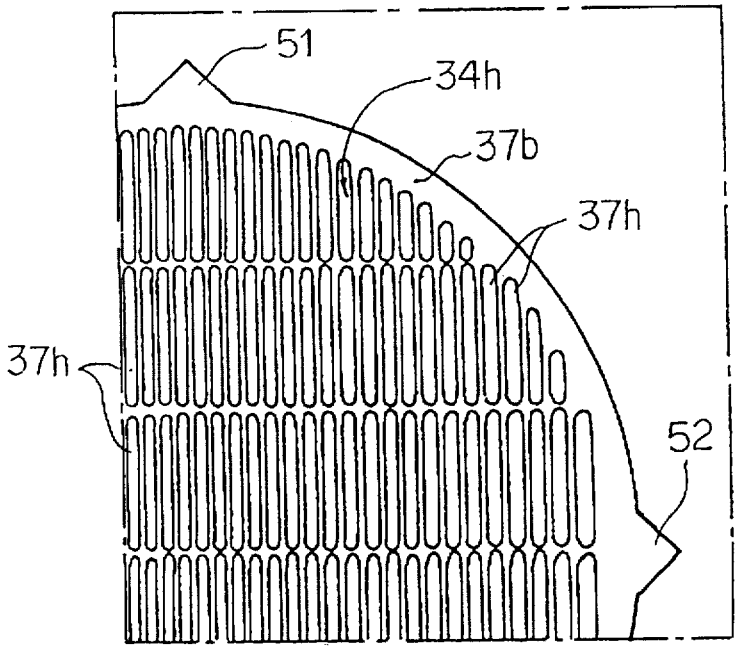
FIG. 3*b* is a fragmentally enlarged view showing part of the mesh plate which is enclosed by a dot-chain line "A" in FIG. 3*a;*
Figure 3C:
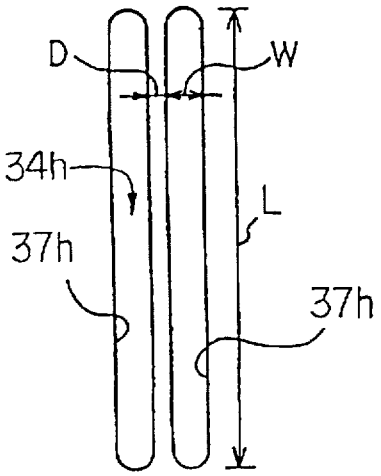
FIG. 3*c* is an enlarged view of a plurality of fluid passage holes shown in FIG. 3*b;*

The expansion piston 32 is adapted to define a cylindrical expansion chamber 35 in the expansion cylinder 31, and is constituted by a cylindrical core casing 33 and a stack body core 34. The core casing 33 consists of an upper and lower casing members 33*a* and 33*b* connected with each other by an adhesive. The upper casing member 33*a* is formed with a first opening 33*c*, while the lower casing member 33*b* is formed with a second opening 33*d*. On the other hand, the stack body core 34 includes a plurality of mesh plates 37 each called a matrix and having a plurality of fluid passage holes 37*h* as best shown in FIGS. 3*a*, 3*b* and 3*c*. The mesh plates 37 number for example more than 1000 and are stacked on one another to form a plurality of fluid passageways 34*h* extending along the center axis of the stack body core 34 and each consisting of the fluid passage holes 37*h* of the mesh plates 37. The stack body core 34 is housed in the core casing 33 to have the fluid passageways 34*h* held in fluid communication with the first and second openings 33*c* and 33*d*. This stack body core 34 is adapted to have a fluid cooling medium introduced into the fluid passageways 34*h* to carry out heat exchange between the stack body core 34 and the fluid cooling medium. The above core casing 33 and the stack body core 34 as a whole constitute a regenerative heat exchanger unit 50 which is received in and retained by the expansion cylinder 31 through a plurality of seal rings 39*a*, 39*b* and 39*c*. The seal rings 39*a* is adapted to hermetically seal an annular gap 41 formed between the inner surface of the expansion cylinder 31 and the outer surface of the expansion piston 32 and to have the expansion chamber 35 separated from the annular gap 41, while the seal rings 39*b* and 39*c* are adapted to hermetically seal the annular gap 41 to reliably introduce the fluid cooling medium into the second opening 33*d* of the core casing 33 from the compression chamber 25.

The fluid conduit 40 is connected at its one end to the upper end portion of the compression cylinder 21 and has an inner passageway 40*a* held in fluid communication with the compression chamber 25. The fluid conduit 40 is connected at its the other end to the lower end portion of the expansion cylinder 31 to have the inner passageway 40*a* held in fluid communication with the second opening 33*d* of the core casing 33 through the annular gap 41 formed between the expansion cylinder 31 and the expansion piston 32. The compression chamber 25, the inner passageway 40*a* of the fluid conduit 40, the annular gap 41, the first and second openings 33*c* and 33*d* of the core casing 33, the fluid passageways 34*h* of the stack body core 34, and the expansion chamber 35 are filled with a high pressure fluid cooling medium such as helium, hydrogen and nitrogen.

The expansion chamber 35 is held in fluid communication with the compression chamber 25 through the first and second openings 33*c* and 33*d*, the fluid passageways 34*h* of the stack body core 34, and the fluid passageway 40*a* of the fluid conduit 40. The expansion piston 32 is adapted to reciprocally be moved by driving means 38 between its lowermost and uppermost positions, i.e., the top and bottom dead centers to compress and expand the fluid cooling medium in the expansion chamber 35.

As best shown in FIGS. 3*a* and 3*b*, each of the mesh plates 37 has on its outer periphery 37*a* a pair of reference mark portions 51 and 52 each positioned with respect to the fluid passage holes 37*h* around the center axis of the stack body core 34. The mesh plates 37 collectively forms two rows of reference mark portions 51 and 52 both of which indicate the form of each of the fluid passageways 34*h*. The present embodiment is exemplified in FIG. 3*b* as having the reference mark portions 51 and 52 each shaped to be triangular and to protrude from the outer peripheral portion 37*a* of the mesh plate 37. The reference mark portions 51 and 52 may be rounded, dented or painted to be distinguishable from the remaining portions of the mesh plate 37 according to the present invention. Each of the mesh plates 37 comprises a base metal plate not shown in the drawings and at least one flat photo resist layer 37*b* laid on the base metal plate to surround the openings of the fluid passage holes 37*h*. The photo resist layer 37*b* is patterned to have a plurality of holes coincident with the shapes of the fluid passage holes 37*h* to etch the fluid passage holes 37*h* in the mesh plates 37. The fluid passage holes 37*h* of the mesh plate 37 may be formed by a known lithography technology or the like.

As shown in FIG. 3*c*, each of the fluid passage holes 37*h* is formed in the shape of a slit elongated in a predetermined elongation direction with respect to the reference mark portions 51 and 52, and has a length "L" set at 1 mm and a slit width "W" of 50 μm with a spacing distance "D" set at 50 μm between two adjacent fluid passage holes 37*h*.

Figure 4:
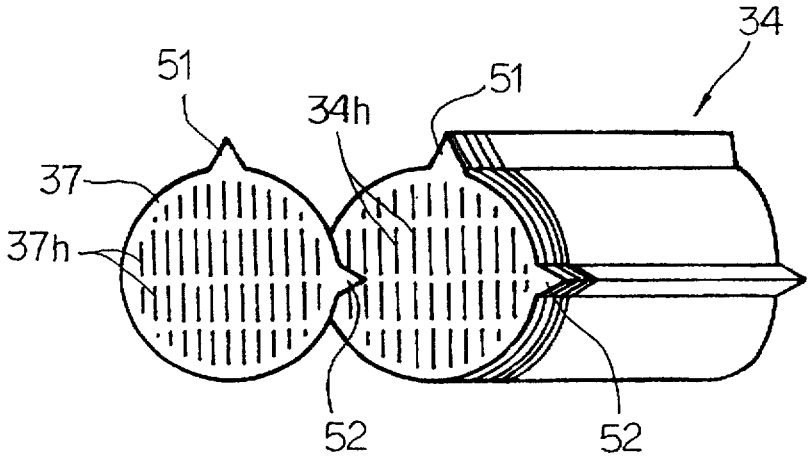
FIG. 4 is a perspective view of the first embodiment of the stacked mesh plates forming part of the regenerative heat exchanger and each having a plurality of fluid passage holes elongated in a single direction and a pair of reference mark portions.

The first embodiment of the stacked mesh plates 37 forming part of the regenerative heat exchanger is particularly exemplified in FIG. 4 as having the fluid passage holes 37*h* of the mesh plates 37 arranged to be identical with one another in the elongation direction.

The refrigerator constructed as above is so operated as to complete one cycle of the reversed Stirling cycle consisting of an isothermal compression stroke, an isovolumeric (or isochronic) heat discharging stroke, an isothermal expansion stroke, and an isovolumeric heat absorbing stroke. The reciprocating motion cycle of the compression piston 22 is in coincidence with that of the expansion piston 32, while the cycle of the compression piston 22 is delayed from that of the expansion piston 32 by one fourth cycle, i.e., a phase angle of 90 degrees.

The isothermal compression stroke is carried out by the compression piston 22 to have the fluid cooling medium compressed in the compression chamber 25 to produce heat in the compression chamber 25. The compressed fluid cooling medium in the compression chambers 25 is discharged from the compression chamber 25 through the fluid conduit 40.

The isovolumeric heat discharging stroke is then performed to transfer the compressed fluid cooling medium to the expansion chamber 35 through the fluid passageways 34*h* of the stack body core 34 by downwardly moving the expansion piston 32 and upwardly moving the compression piston 22 -between their top dead centers and the intermediate points. At this time, the regenerative heat exchanger unit 50 is operated to deprive heat of the compressed fluid cooling medium to cool the fluid cooling medium to be transferred to the expansion chamber 35.

The isothermal expansion stroke is then carried out to have the fluid cooling medium in the expansion chamber 35 expanded in its volume under the isothermal state. At this time, the fluid cooling medium absorbs heat from the surroundings, especially from the cooling cover 36. This leads to the fact that the cooling cover 36 and the cooling object 10 can be sufficiently cooled by the fluid cooling medium.

The isovolumeric heat absorbing stroke is then performed to have the fluid cooling medium transferred to the compression chamber 25 from the expansion chamber 35 while the compression piston 22 is downwardly moved and the expansion piston 32 is downwardly moved between their intermediate points and bottom dead centers. When the cool fluid cooling medium is being transferred from the expansion chamber 35 to the compression chamber 25, heat exchange is performed between the fluid cooling medium held at a relatively low temperature and the regenerative heat exchanger unit 50 maintained at a relatively high temperature after the former isovolumeric heat discharging stroke is performed. This results in the fact that the regenerative heat exchanger unit 50 is cooled by the fluid cooling medium.

The above four strokes cause heat exchange to be performed while the fluid cooling medium is transferred back and forth between the compression and expansion chambers 25 and 35 by the regenerative heat exchanger unit 50. The four strokes are repeated with the compression and expansion pistons 22 and 32 reciprocated, which results in the fact that the cooling object 10 is sufficiently cooled and refrigerated by the fluid cooling medium.

Under these conditions, heat transmission is retarded between each pair of adjacent mesh plates 37 by the photo resist layer **37*b* having its heat conductivity smaller than that of the base metal plates of the mesh plates 37, thereby making it possible to perform desirable strokes of the reversed Stirling cycle in the refrigerator to improve the efficiency of the regenerative heat exchanger unit 50**.

If, on the other hand, the shapes of the fluid passageways **34*h* are required to be changed in response to the cooling condition or the properties of the refrigerator, the arrangement of the mesh plates 37 is changed. In this instance, the reference mark portions 51 and 52 provided on the periphery 37*a* of the mesh plates 37 enable to modify and adjust the shapes such as diameters, sectional areas, lengths and axial directions of the fluid passageways 34*h* into other desirable shapes by relatively rotating the mesh plates 37 with reference to the reference mark portions 51 and 52. This means that the fluid passageways 34*h* can be easily adjusted and changed in shape without changing the shapes of the mesh plates 37 or the size of the core casing 33 in spite of the fact that the mesh plates 37 have their identical circular shapes. New mesh plates are unnecessary for adjusting and modifying the shapes of the fluid passageways 34*h* of the stack body core 34**.

Figure 5:
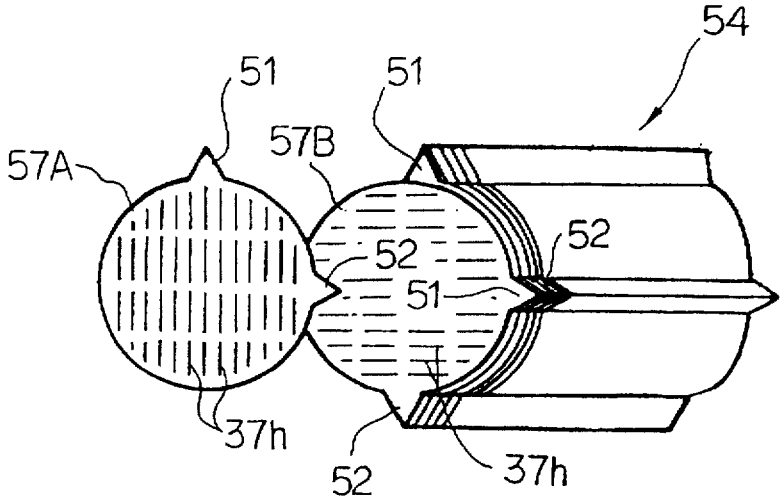
FIG. 5 is a perspective view of the second embodiment of the stacked mesh plates forming part of the regenerative heat exchanger and each having a plurality of fluid passage holes elongated in one of two different directions and reference mark portions extending on three lines circumferentially spaced from one another.

The second embodiment of the stacked mesh plates forming part of the regenerative heat exchanger is exemplified in FIG. 5 as comprising a stack body core 54 in which the fluid passage holes **37*h* are arranged to have their elongation directions different from one another. The stack body core 54 includes first and second mesh plates 57A and 57B having two different elongation directions of the fluid passage holes 37*h*, and held in contact with each other to have their reference mark portions 51 and 52 lined up in three lines. In this case, each of the fluid passageways becomes to be minimum in cross sectional area where the fluid passage holes of the first and second mesh plates 57A and 57**B cross each other.

Figure 6:
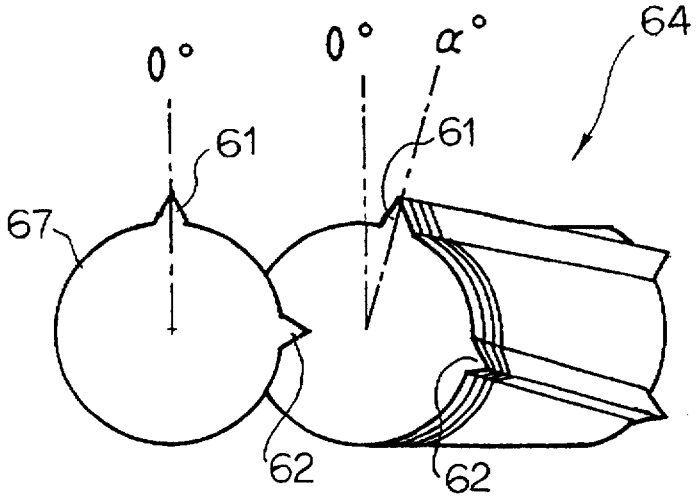
FIG. 6 is a perspective view of the third embodiment of the stacked mesh plates forming part of the regenerative heat exchanger and held in contact with one another to have their reference mark portions arranged along two spiral lines.

The third embodiment of the stacked mesh plates forming part of the regenerative heat exchanger is exemplified in FIG. 6 as comprising a stack body core 64 which includes a plurality of mesh plates 67 each having an elongation directions of the fluid passage holes different from that of another mesh plate 67 and held in contact with one another to have their reference mark portions 61, 62 arranged in two spiral lines. The difference of the elongation directions of the fluid passage holes between each adjacent pair of mesh plates 37 is set at $\alpha°$ that is exaggeratedly shown in FIG. 6.

Figure 7:
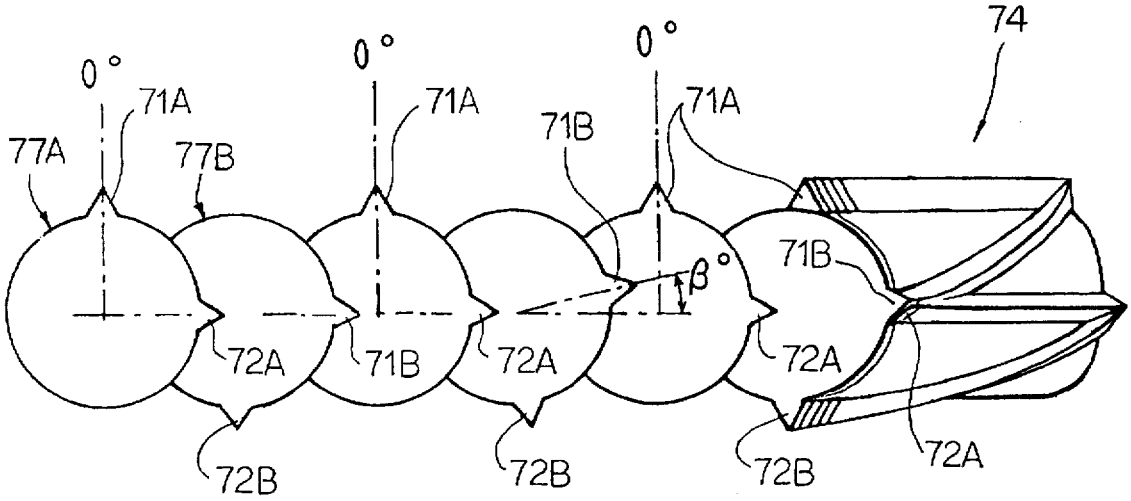
FIG. 7 is a perspective view of the fourth embodiment of the stacked mesh plates forming part of the regenerative heat exchanger and held in contact with one another to have their reference mark portions arranged along a set of straight and spiral lines.

The fourth embodiment of the stacked mesh plates forming part of the regenerative heat exchanger is exemplified in FIG. 7 as comprising a stack body core 74 which includes first and second groups of mesh plates 77A and 77B. The mesh plates 77A and 77B have different indexing angles and are held in 35 contact with each other to have first reference mark portions 71A, 72A arranged in two straight lines and second reference mark portions 71B, 72B arranged in two spiral lines. The first group of mesh plates 77A have a single elongation direction of the fluid passage holes such as for example 0°, whilst the second group of mesh plates 77B have respective elongation directions of the fluid passage holes different from one another by an angle $\beta°$ between each adjacent pair of the second group of mesh plates 77B.

Figure 8:
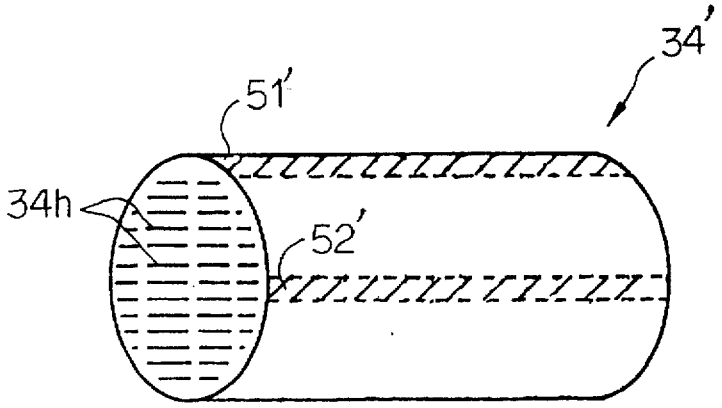
FIG. 8 is a perspective view of the fifth embodiment of the stacked mesh plates forming part of the regenerative heat exchanger and having reference mark portions each chamfered but having specific indications.

The fifth embodiment of the stacked mesh plates forming part of the regenerative heat exchanger is exemplified in FIG. 8 as comprising a stack body core 34' having on its periphery a plurality of specified form portions 51' and 52'. The specified form portions 51' and 52' are respectively shaped by chamfering or cutting the reference mark portions 51 and 52 of the stack body core 34 to have their specified indications distinguishable from the remaining outer peripheral portions of the stack body core 34'. The specified form portions 51' and 52' of the stack body core 34' can facilitate to insert the stack body core 34' in the core casing 33. Other reference mark portions of the above replaceable stack body cores may also be chamfered or almost cut away from the stack body core.

Figure 9:
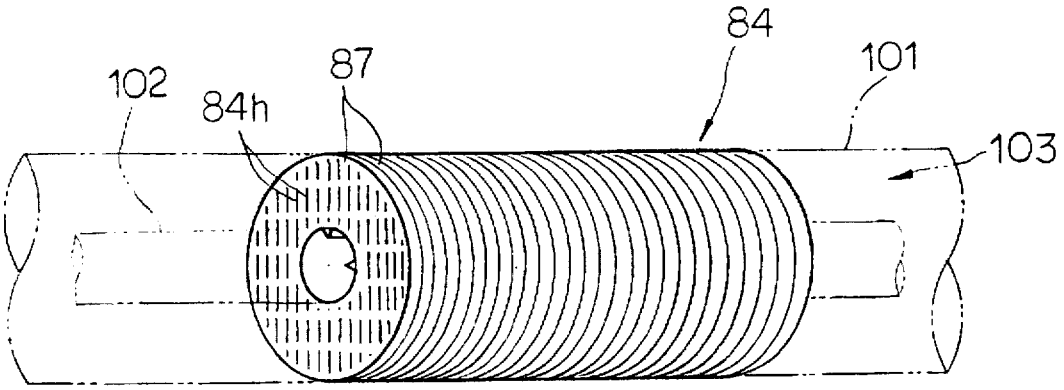
FIG. 9 is a perspective view of the sixth embodiment of the stacked mesh plates forming part of the regenerative heat exchanger and each having outer and inner peripheral portions.
Figure 10:
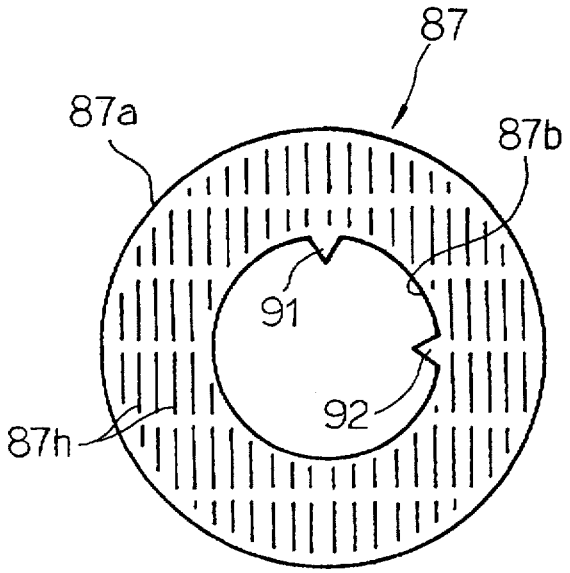
FIG. 10 is a plan view of the mesh plate having a pair of reference mark portions inwardly protruding from the inner peripheral portion.
Figure 11:
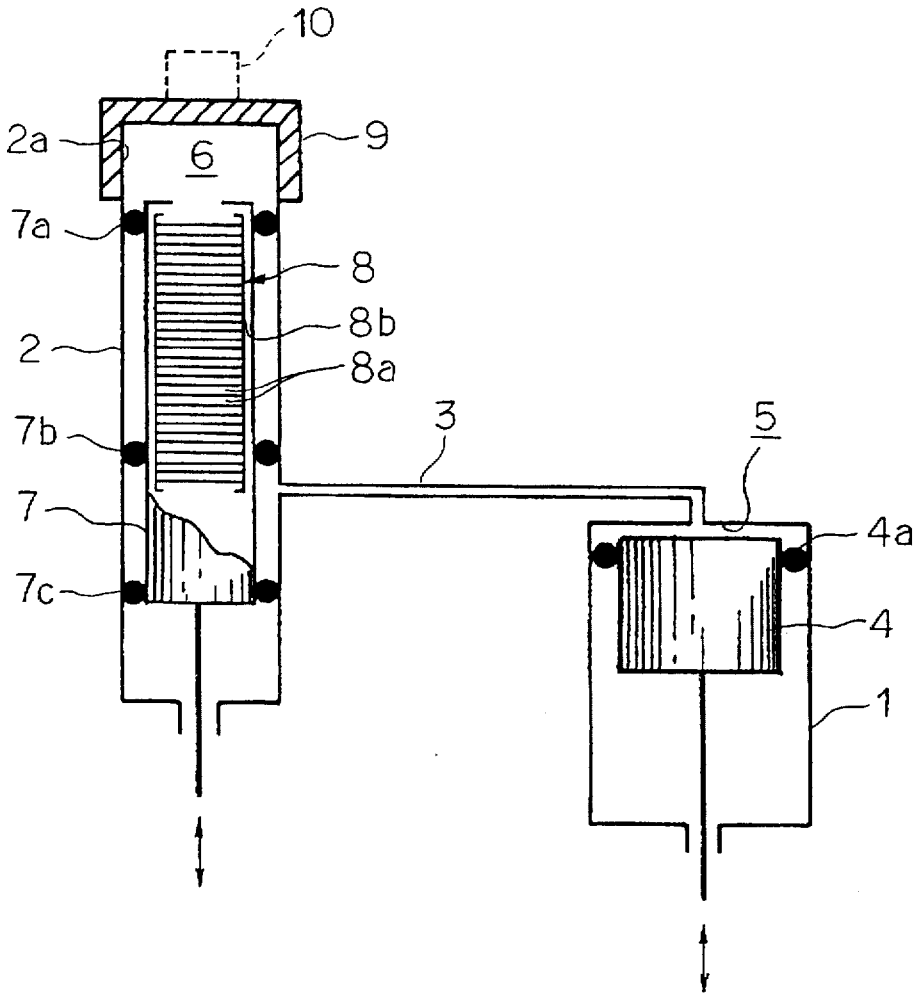
FIG. 11 (PRIOR ART)
FIG. 11 is a schematic view of a prior art inverse Stirling refrigerator.
Figure 12:
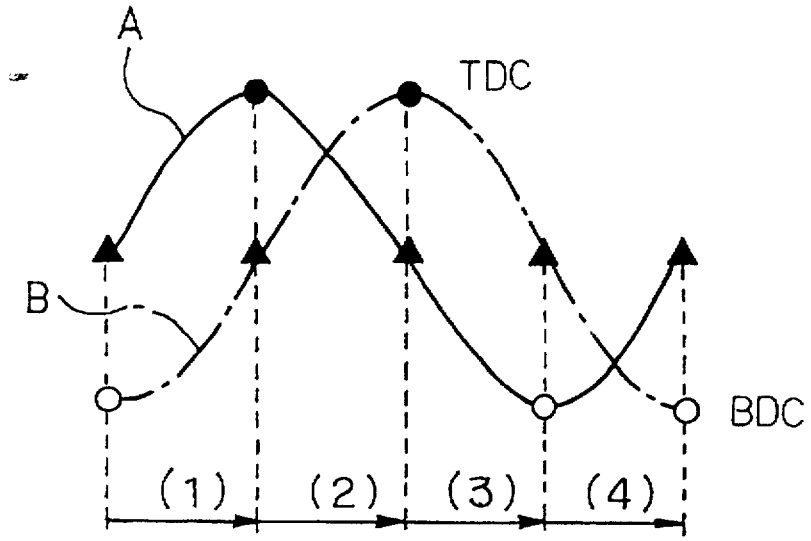
FIG. 12 (PRIOR ART)
FIG. 12 is a graph showing a pair of sine curves indicative of the loci of compression and expansion pistons.

The sixth embodiment of the stacked mesh plates forming part of the regenerative heat exchanger is exemplified in FIG. 9 as comprising a stack body core 84 including a plurality of annular mesh plates 87 each of which has outer and inner peripheral portions **87*a* and 87*b* and a pair of reference mark portions 91 and 92 inwardly protruding from the inner surface portion 87*b* of the mesh plate 87. As shown in FIG. 10, each of the mesh plates 87 has a plurality of fluid passage holes 87*h* each formed in the shape of a slit elongated in a predetermined elongation direction with respect to the reference mark portions 91 and 92. The fluid passage holes 87*h* of the mesh plates 87 collectively form a plurality of fluid passageways 84*h* of the stack body core 84 when the mesh plates 87 are stacked on one another to form the stack body core 84. The fluid passage holes 87*h* may be arranged to be different from or to be identical to one another in the elongation direction with the rows of reference mark portions 91 and 92. The stack body core 84 of this regenerative heat exchanger can be received in an outer tube 101 which forms a hollow cylindrical passageway 103 in combination with an inner tube 102 to have the fluid cooling medium pass through the fluid passageways 84*h* each held in fluid communication with the hollow cylindrical passageway 103**.

If the shapes of the fluid passageways are required to be changed in response to the cooling condition or the properties of the refrigerator, the fluid passageways of the stack body core 84 can be easily adjusted and changed in shape in spite of the fact that the mesh plates 87 have their respective circular shapes. Therefore, the shapes of the fluid passageways of the stack body core 84 can be modified and adjusted into other desirable shapes by relatively rotating the mesh plates 87 with reference to the reference mark portions 91 and 92.

The present invention has thus been shown and described with reference to specific embodiments, however, it should be noted that the present invention is not limited to the details of the illustrated structures but changes and modifications may be made without departing from the scope of the appended claims.

What is claimed is:

1. A regenerative heat exchanger comprising:

a cylindrical core casing having first and second openings; and a stack body core formed by a plurality of circular mesh plates each having a plurality of fluid passage holes and stacked on one another to form a plurality of fluid passageways each comprising said plurality of fluid passage holes, said stack body core being housed in said core casing to have said fluid passageways held in fluid communication with said first and second openings, said fluid passageways allowing a fluid cooling medium to be introduced thereinto to carry out heat exchange between said stack body core and said fluid cooling medium.

wherein each of said mesh plates has obverse and reverse surfaces and a peripheral surface and is formed with a protrusion extending from said peripheral surface in parallel relationship to said obverse and reverse surfaces, the protrusion of each mesh plate being positioned with respect to said fluid passage holes around the center axis of said stack body core, said mesh plates being stacked so as to form at least a row of the protrusions, the arrangement of the row of the protrusions being changeable and indicating the cross-sectional areas and the lengths of said fluid passageways.

2. A regenerative heat exchanger as set forth in claim 1, wherein each of said fluid passage holes is formed in the shape of a slit elongated in a predetermined elongation direction with respect to said protrusion, said stacked mesh plates having said fluid passage holes identical with one another in said elongation direction.

3. A regenerative heat exchanger as set forth in claim 1, wherein said fluid passage holes of any one of said mesh plates are slits having elongation axes which are parallel to one another, the protrusions of adjoining mesh plates being deviated from each other around the center axis of said stack body core by a certain angle at which the elongation axes of the slits of the adjoining mesh plates cross each other.

4. A regenerative heat exchanger as set forth in claim 1, wherein each of said mesh plates has a flat photo resist layer surrounding the openings of said fluid passage holes.

5. A regenerative heat exchanger as set forth in claim 1, wherein each of said protrusions of said mesh plates is triangular in shape.

6. A regenerative heat exchanger as set forth in claim 1, wherein each of said protrusions of said mesh plates protrudes from the inner peripheral portion of said mesh plate.

7. A regenerative heat exchanger as set forth in claim 6, wherein each of said protrusions of said mesh plates is triangular in shape.

* * * * *